US011764484B2

(12) United States Patent
Steel et al.

(10) Patent No.: US 11,764,484 B2
(45) Date of Patent: Sep. 19, 2023

(54) PHASED ARRAY ANTENNA APPARATUS AND METHOD

(71) Applicant: SOFANT TECHNOLOGIES LTD, Edinburgh (GB)

(72) Inventors: Victor Steel, Edinburgh Lothian (GB); Andrew Christie, Edinburgh Lothian (GB)

(73) Assignee: SOFANT TECHNOLOGIES LTD, Edinburgh (GB)

( * ) Notice: Subject to any disclaimer, the term of this patent is extended or adjusted under 35 U.S.C. 154(b) by 0 days.

(21) Appl. No.: 18/017,068

(22) PCT Filed: Jul. 21, 2021

(86) PCT No.: PCT/GB2021/051889
§ 371 (c)(1),
(2) Date: Jan. 19, 2023

(87) PCT Pub. No.: WO2022/018443
PCT Pub. Date: Jan. 27, 2022

(65) Prior Publication Data

US 2023/0216212 A1 Jul. 6, 2023

(30) Foreign Application Priority Data

Jul. 21, 2020 (GB) ..... 2011276

(51) Int. Cl.
*H01Q 3/26* (2006.01)
*H01Q 21/06* (2006.01)
(Continued)

(52) U.S. Cl.
CPC ..... *H01Q 21/065* (2013.01); *H01Q 3/267* (2013.01); *H01Q 3/28* (2013.01); *H01Q 21/0025* (2013.01); *H01Q 21/245* (2013.01)

(58) Field of Classification Search
CPC ..... H01Q 21/065; H01Q 3/267; H01Q 3/28; H01Q 21/0025; H01Q 21/245
See application file for complete search history.

(56) References Cited

U.S. PATENT DOCUMENTS 5,079,557 A 1/1992 Hopwood et al.
5,155,495 A 10/1992 Hately
(Continued)

FOREIGN PATENT DOCUMENTS

JP 2004241972 A 8/2004
JP 2004363801 A 12/2004
(Continued)

OTHER PUBLICATIONS

Mailloux, Robert J., "Sidelobe Levels Due to Periodic Phrase, Amplitude, and Time-Delay Quantization", Artech House Boston, USA, Array Error Effects, XP55850911A, pp. 362-364.
(Continued)

*Primary Examiner* — Dieu Hien T Duong
(74) *Attorney, Agent, or Firm* — Haynes and Boone, LLP

(57) ABSTRACT

The present invention provides phased array antenna apparatus (200) for operation in frequencies above six gigahertz. The apparatus (200) comprises: a plurality of sub-arrays (208) together configured to form a phased array antenna, each sub-array (208) comprising at least four antenna elements (220), each antenna element (220) for receiving an input signal from the sub-array (220) and comprising: an antenna (230) for transmission of the input signal; and a signal modification component (222) to adjust a phase of the input signal during propagation to the antenna (230); and a plurality of power amplifiers (212), wherein each sub-array (208) is provided with a one of the plurality of power amplifiers (212), wherein each sub-array (208) is arranged to be provided with an amplified input signal, and each antenna element (220) of the sub-array (208) is configured to be
(Continued)

provided with the amplified input signal of the respective sub-array (208) as the input signal to the antenna element (220), and wherein the power amplifier (212) for each sub-array (208) is configured to receive a phased array input signal for amplification and to output the respective amplified input signal to the respective sub-array (208). The power amplifier (212) for each sub-array (208) may be physically separate and distinct from each sub-array (208).

20 Claims, 6 Drawing Sheets

(51) Int. Cl.

| | |
|---|---|
| ***H01Q 21/00*** | (2006.01) |
| ***H01Q 3/28*** | (2006.01) |
| ***H01Q 21/24*** | (2006.01) |

(56) References Cited

U.S. PATENT DOCUMENTS

| | | | |
|---|---|---|---|
| 5,548,295 | A | 8/1996 | Lo Forti |
| 6,404,404 | B1 | 6/2002 | Chen et al. |
| 6,686,885 | B1 | 2/2004 | Barkdoll |
| 10,193,236 | B1 | 1/2019 | Lee |
| 2002/0089447 | A1 | 7/2002 | Li |
| 2004/0262645 | A1 | 12/2004 | Huff |
| 2007/0120742 | A1 | 5/2007 | Soler Castany |
| 2011/0068971 | A1 | 3/2011 | Kusyk |
| 2011/0074630 | A1 | 3/2011 | Snow |
| 2011/0074646 | A1 | 3/2011 | Snow |
| 2011/0150050 | A1 | 6/2011 | Trigui |
| 2012/0306578 | A1 | 12/2012 | Fast |
| 2016/0359461 | A1 | 12/2016 | He et al. |
| 2017/0062926 | A1 | 3/2017 | Bonebright et al. |
| 2017/0207547 | A1* | 7/2017 | Zhai ..... H01Q 21/065 |
| 2018/0011180 | A1 | 1/2018 | Warnick et al. |
| 2019/0372199 | A1 | 12/2019 | Haridas et al. |

FOREIGN PATENT DOCUMENTS

| | | | |
|---|---|---|---|
| JP | 2015005906 | A | 1/2015 |
| JP | 2015159481 | A | 9/2015 |
| JP | 2019176435 | A | 10/2019 |
| KP | 2004241972 | A | 8/2004 |
| WO | 2016035828 | A1 | 3/2016 |

OTHER PUBLICATIONS

International Search Report dated Nov. 3, 2021 for Application No. PCT/GB2021/051889. 18 pages.

Search Report dated Jan. 8, 2021 for Application No. GB2011276.9. 5 Pages.

International Preliminary Report on Patentability dated Oct. 25, 2022 for Application No. PCT/GB2021/051889. 8 pages.

* cited by examiner

PHASED ARRAY ANTENNA APPARATUS AND METHOD

CROSS-REFERENCE TO RELATED APPLICATIONS

This application is a 371 United States national phase application of co-pending international patent application No. PCT/GB2021/051889, filed Jul. 21, 2021 which claims priority to GB 2011276.9 filed Jul. 21, 2020, the entire contents of which are incorporated by reference in this application.

FIELD OF THE INVENTION

The invention relates to phased array antenna apparatus and methods of testing and operating the same. Particularly, the invention relates to phased array antenna apparatus for operation in frequencies above six gigahertz, and associated methods.

BACKGROUND TO THE INVENTION

Phased array antennas for operation in radio frequencies, for example frequencies above six gigahertz, comprise a plurality of antenna elements. Typically, several antenna elements are mounted together in sub-arrays. A phased array antenna may be formed from several sub-arrays. By altering the phase of each signal transmitted from the individual antennas of the antenna elements of the phased array antenna, the beam of the antenna can be shaped and/or steered to optimise operational efficiency. In some examples, beam steering can also be achieved by selecting which particular antenna elements are used.

Typically, a signal to be transmitted by the phased array antenna will need amplification to increase the power of the transmitted signal. The precise amount of amplification varies for each antenna element in the phased array antenna. Currently, to achieve this, each antenna element comprises a dedicated power amplifier to provide the required different levels of amplification. Each power amplifier is typically located close to the antenna element to avoid RF signal losses. In such locations, careful heat management is required to route heat generated by the power amplifier away from the antenna element. Further electrical components (such as phase shifters and attenuators) are also provided on each antenna element.

It is in this context that the present disclosure has been devised.

SUMMARY OF THE INVENTION

In accordance with an aspect of the present disclosure, there is provided phased array antenna apparatus. Typically, the phased array antenna apparatus is for operation in radio frequencies, for example frequencies above six gigahertz. The apparatus comprises a plurality of sub-arrays together configured to form a phased array antenna. Each sub-array may comprise at least four antenna elements. Each sub-array may comprise an input configured to receive an input signal, and a plurality of respective sub-array circuits between the input and an antenna of the respective antenna element. The antenna is for transmission of the input signal. Each sub-array circuit may comprise a signal modification component configured to adjust a phase of the input signal during propagation to the antenna. The apparatus further comprises a plurality of power amplifiers. Typically, the sub-array circuits of each sub-array are connected to a one of the plurality of power amplifiers via the input. Each sub-array may be arranged to be provided with an amplified input signal at the input as the input signal to the input. Each power amplifier may be configured to receive a phased array input signal for amplification and to output the respective amplified input signal to the plurality of sub-array circuits of the respective sub-array connected to the power amplifier.

Thus, by using a single power amplifier to amplify the signal for all of the antenna elements in a sub-array, it is not necessary to provide a dedicated power amplifier for each antenna element in the sub-array. In this way, the power amplifier, which can generate significant heat during operation, can be located away from the antenna element. Furthermore, because fewer power amplifiers are used, it is easier to efficiently remove waste heat from the power amplifier. In other words, the performance and efficiency of the sub-array are improved. Additionally, the sub-array is particularly reliable because there are fewer power amplifiers having a possibility of failure. Another benefit is that more sophisticated power amplifiers can be used, with improved functionality, for the same, or even lower, manufacturing cost. Thus, the phased array antenna apparatus can be manufactured more efficiently. Furthermore, any phase inconsistencies introduced by inclusion of a power amplifier for each antenna element can be removed by providing a single power amplifier shared by all antenna elements in the sub-array.

It will be understood that typically the antenna and the signal modification component of each sub-array circuit are provided as part of the antenna elements. Therefore, a sub-array circuit will still be considered to be provided between the input and the respective antenna elements even where the sub-array circuit includes components being part of the antenna element.

In some examples, some of the sub-arrays requiring less amplification of the array input signal may be provided without a dedicated power amplifier. Instead such sub-arrays use amplification provided by a further power amplifier configured to perform preliminary amplification of the array input signal. Typically, an output of the further power amplifier is provided to each of the plurality of other power amplifiers described hereinbefore. Typically, such sub-arrays are towards (e.g., at) one or more edges of the phased array.

Each power amplifier may be separated from the plurality of antenna elements. Thus, an antenna board on which the antenna elements are provided need not be configured to provide for heat removal from the power amplifier. This enables the antenna board to be simpler, allowing for a simpler phased array antenna.

The power amplifier may be provided on a control board of the phased array antenna apparatus, separate from one or more antenna boards of the sub-array at which the plurality of antenna elements are provided. The control board may be provided away from the sub-array. The control board may be further provided with control circuitry configured to control the power amplifier. The control circuitry may be further configured to control one or more components of the plurality of antenna elements of the sub-array, such as configured to control the signal modification component of each of the plurality of antenna elements.

The plurality of power amplifiers may together be configured to output a plurality of different amplified input signals, each of the plurality of different amplified input signals amplified to a different power. In some examples, a first power amplifier of the plurality of power amplifiers may be configured to output a first amplified input signal, amplified to a first power level, and a second power amplifier of the plurality of power amplifiers may be configured to output a second amplified input signal, amplified to a second power level, different from the first power level. The first power amplifier may be the same as the second power amplifier. The first power amplifier may be controlled such that the power amplification provided by the first power amplifier is different to the power amplification provided by the second power amplifier. In other examples, the first power amplifier may be different to the second power amplifier, resulting in the different power amplification levels.

Thus, viewed from another aspect, the present disclosure provides a method of operating phased array antenna apparatus, for example at frequencies above 6 GHz. The method comprises providing phased array antenna apparatus. The phased array antenna apparatus typically comprises: a phased array input configured to receive a phased array input signal; and a plurality of sub-arrays together configured to form a phased array antenna. Each sub-array may comprise a plurality of antenna elements, for example at least four antenna elements, an input configured to receive an input signal, and a plurality of respective sub-array circuits between the input and an antenna of the respective antenna element. The antenna is for transmission of the input signal. The method further comprises: amplifying the phased array input signal to at least two different respective power levels for providing as the input to each of the plurality of sub-arrays. The method further comprises transmitting the input signal from the antenna. Thus, the power levels at each sub-array can be different in different regions of the phased array antenna, without requiring separate amplification at each antenna element of the sub-arrays, which may be inefficient for the reasons described hereinbefore. The different respective power levels may be provided by use of a first power amplifier to provide amplification of the phased array input signal to a first power level, and a second power amplifier to provide amplification of the phased array input signal to a second power level, different from the first power level.

The method may comprise adjusting a phase of the input signal during propagation to the antenna in one or more sub-array circuits. The method may comprise attenuating the input signal in one or more of the sub-array circuits. The method may comprise switchedly routing the input signal in one or more of the sub-array circuits.

A first power amplifier of the plurality of power amplifiers, providing the amplified input signal to a central sub-array of the plurality of sub-arrays in the phased array antenna apparatus may be configured to amplify the phased array input signal to a greater power than a second power amplifier of the plurality of power amplifiers, providing the amplified input signal to a peripheral sub-array of the plurality of sub-arrays in the phased array antenna apparatus. Thus, the amplitude output from the power amplifiers can be tapered across the phased array, as may be advantageous to improve an operating efficiency of the phased array antenna. This is sometimes referred to as amplitude tapering. In other words, the amplitude of the amplified input signal provided to sub-arrays closer to an edge of the phased array antenna is configured to be less than the amplitude of the amplified input signal provided to sub-arrays closer to a centre of the phased array antenna. In this way, the transmission beam of the phased array antenna can be shaped particularly efficiently.

The phased array antenna apparatus may comprise a plurality of test ports for connection of test equipment thereto. The test equipment may comprise a signal analyser to evaluate and optionally align a phase and amplitude response of the phased array antenna apparatus. The signal analyser may further evaluate and optionally align one or more non-linear responses such as Adjacent Channel Power Ratio (ACPR) and spurious emissions. Each test port may be provided in the plurality of sub-array circuits of a respective sub-array. In some examples, the plurality of test ports allow connection of test equipment thereto when the plurality of power amplifiers are in signal communication with the plurality of antenna elements of each of the plurality of sub-arrays via the plurality of sub-array circuits. In other examples, the plurality of test ports cannot be accessed for connection of test equipment thereto when the plurality of power amplifiers are in signal communication with the plurality of antenna elements of each of the plurality of sub-arrays via the plurality of sub-array circuits. Significantly, inclusion of the plurality of test ports allows at least the power amplifiers of the phased array antenna apparatus to be tested without relying on an often inaccurate, expensive and time-consuming over-the-air (OTA) testing procedure. In some examples, substantially the whole transmit/receive chain of the phased array antenna apparatus up to the sub-array can be tested in the above-described manner. Sometimes, the testing is completed during manufacture of the phased array antenna apparatus, before connection of the input of each sub-array to the respective outputs from the plurality of power amplifiers. In such cases, the plurality of test ports can subsequently be re-used for connection of the input of each sub-array to the respective outputs from the plurality of power amplifiers.

The sub-array circuit may comprise one or more electrical components of the antenna elements.

At least one sub-array circuit may comprise an attenuator to attenuate the input signal received from the input. At least one antenna element may comprise the attenuator. More than one sub-array circuit may comprise a respective attenuator. At least one sub-array circuit of more than one sub-array may comprise a respective attenuator. In some examples, every sub-array circuit may comprise a respective attenuator. Thus, individual attenuators in the sub-array circuits can provide fine tuning of the amplitude tapering referred to hereinbefore, though the majority of the amplitude tapering can be provided by the use of power amplifiers providing different amplitudes for different sub-arrays in the phased array antenna apparatus.

It will be understood that an attenuator is any component arranged to reduce a signal power of an input signal. An amount of attenuation may be controllable. Typically, the attenuators described herein are resistive attenuators. In other words, the reduction in signal power is typically achieved using a resistive component. Viewed another way, it can be considered that the attenuators typically do not require a separate power supply to achieve attenuation using active means, such as would be required in an active component. Typically, an attenuator is configured to reduce an RF signal power of the input signal.

The attenuator may be a passive attenuator. Thus, the attenuator uses substantially no external power (e.g., no external power) to attenuate the input signal. Attenuation by a passive attenuator typically does not require power supplied to the passive attenuator from a power supply separate from the input signal to be attenuated. Of course, a control signal may be provided to the passive attenuator to control an amount of attenuation performed by the attenuator, though it will be understood that the control signal cannot be considered to be a power supply. It will further be understood that a power amplifier having a gain of less than one cannot be considered to be a passive attenuator because a power amplifier typically required a separate power supply. The attenuator may be realised by a MEMS switch, sometimes referred to as a MEMS attenuator. In other words, the attenuation may be provided by one or more miniaturised mechanical and electro-mechanical elements. It will be understood that arrangements for MEMS attenuators are known to the skilled person.

Of passive attenuation and power amplification of the amplified input signal, it may be that only passive attenuation of the amplified input signal may be performed in at least one of the plurality of sub-array circuits. In other words, power amplification is not performed in at least one of the plurality of sub-array circuits. Thus, power requirements to the electrical components forming the at least one of the plurality of sub-array circuits are reduced. Typically, at least one (e.g., a plurality, sometimes each) of the electrical components of the plurality of sub-array circuits are provided on the respective antenna elements, meaning also that the power requirements to the antenna elements are also reduced. In some examples, power amplification is not performed in any of the plurality of sub-array circuits.

The input may be an input port. In this way, each sub-array may comprise the input port for receiving the amplified input signal. In at least one of the sub-array circuits, between the input port and the antenna of the respective sub-array circuit, of one or more active components and one or more passive components to modify the amplified input signal received at the input port, only the one or more passive components may be present.

It will be understood that a passive component is a component where the overall power of the input signal on which the passive component operates is not increased by operation of the passive component. In other words, the passive component consumes little or even substantially no external power (e.g., no external power) during operation. Operation of the passive component typically does not require power supplied to the passive component from a power supply separate from the input signal on which the passive component is configured to operate. Of course, a control signal may be provided to the passive component to control the operation performed by the passive component, though it will be understood that the control signal cannot be considered to be a power supply. Conversely, an active component is a component where the overall power of the input signal on which the active component operates is increased by operation of the active component, with the increased power typically being supplied from a power supply separate from the active component. A power amplifier is an example of an active component. An active component typically generates a substantial quantity of heat that would need to be routed away from the antenna element if the active component were to be provided thereon. Whilst a passive component may also generate heat (e.g., a resistive attenuator), the quantity of heat generated is typically less than many active components. Thus, the use of only one or more passive components in the sub-array circuit ensures that the antenna elements do not need such significant thermal management to be provided thereon. As previously, this enables such antenna elements to have a simpler construction and less signal degradation. Typically, any control signal for controlling the passive component may also be of relatively low power and cannot be considered to be a power supply. In some examples, in the sub-array circuit between the input port and each antenna in the sub-array, of one or more active components and one or more passive components, only the one or more passive components are present. Thus, the advantages above can apply to every antenna element in a sub-array, and/or to every sub-array in the phased array antenna apparatus. Therefore, it may be that the sub-array need not have such significant thermal management provided thereon.

Typically, the passive components described herein will have substantially no effect on a DC power of an input signal thereto, and will reduce the RF power of the input signal, either intentionally due to RF attenuation, or through inherent RF losses in the passive component.

At least one of the one or more passive components may be provided with a low-current control signal for controlling operation of the respective passive component. The low-current control signal may be arranged to have a maximum current of less than 100 milliamps. The maximum current may be less than 50 milliamps. The maximum current may be less than 20 milliamps. Thus, the passive components are operable by only low power control signals, meaning only a very small amount of heat will be generated from any control signal during operation.

It will be understood that in some examples each sub-array of the phased array antenna apparatus may be provided on a separate physical board of the phased array antenna apparatus. In other examples, a sub-array will be understood to be a logical construct, the components of which can be provided on a plurality of different boards, arranged separately.

The one or more passive components may comprise one or more MEMS components. It will be understood that a MEMS component is typically a passive component. The one or more MEMS components may comprise one or more MEMS switches.

The one or more MEMS components may be configured to provide attenuation. The one or more MEMS components may be configured to provide phase shifting. The one or more MEMS components may be configured to provide RF switching. The one or more MEMS components may be configured to provide RF tuning such as impedance tuning. Thus, substantially all required operations on the signal, performed in the signal path between the input port for the antenna element and the antenna of the antenna element can be performed using a passive component, such as a MEMS component. The use of MEMS components in this way results in particularly low RF losses, meaning that further amplification of the signal is not required at the antenna element for successful transmission from the antenna. In some examples, the one or more MEMS components are configured to provide at least two of attenuation, phase shifting, RF tuning, and RF switching to the amplified input signal in the signal path. In some examples, the one or MEMS components are configured to provide all of attenuation, phase shifting, RF tuning, and RF switching. Typically, the MEMS component may be one or more MEMS switches, configured to provide one or more of attenuation, phase shifting, RF tuning, and RF switching.

It will be understood that the use of MEMS components in this way is particularly enabled by the use of the hereinbefore described configuration where each input signal for each antenna in a subarray is already amplified by the power amplifier for the sub-array. At the sub-array, typically only a small adjustment (i.e., attenuation) of the power level of the input signal is required for each respective antenna to provide the required amplitude tapering for efficient operation of the phased array apparatus. Were a larger attenuation to be required, then it may be that at least some MEMS attenuator designs would be inappropriate, making the system less efficient.

In some examples, each of the components of the antenna element in the transmission path between the power amplifier and the antenna are low loss components. In other words, the inherent RF losses (not intentional) of the components are low. For example, RF losses of the components at high frequencies, for example 30 GHz, are in the range of 0.5 to 2.5 dB. It will be understood that this is desirable where the power amplifier, with which the sub-array is provided, is away from the plurality of antenna elements of the sub-array. Were the components of the antenna element to exhibit losses that could not be considered to be low loss, the power amplifier would be unable to be located away from the antenna elements. Therefore, by using low loss components in the transmission path between the power amplifier and the antenna, the power amplifier need not be provided, for example, on the same board as the antenna elements. Thus, the cooling requirements and/or complexity of a board on which the antenna elements of the sub-array are provided can be reduced.

As used herein, the term "low loss" will be understood to mean that the inherent power losses of the RF signal are low. Of course, it will be understood that a controllable attenuator can also be considered to be a low loss component if it's minimum loss is low (for example 0.5 to 2.5 dB), even where the attenuator can be controlled to attenuate an input signal to a greater extent (e.g., to provide RF attenuation of up to 15.5 dB).

It will be understood that the signal modification component is substantially any component to cause a phase shift in at least one frequency of the signal. In some examples, the signal modification component may be implemented by a time delay component to delay propagation of the signal. In other examples, the signal modification component may be implemented by a phase shift component to alter a phase of the signal for at least one frequency of the signal. It may be that the phase shift component alters the phase of the signal substantially without delaying propagation of the signal. Such components are required in phased array antennas to delay or shift the phase of signals to different antennas by different amounts in order to electronically "steer" the beam (transmitter or receiver beam) of the phased array antenna.

Each signal modification component may comprise one or more phase shifters to impart a phase shift to the input signal to thereby alter the phase of the input signal to the antenna by an amount less than a whole wavelength. It will be understood that the signal modification component may be realised by a single phase shifter component arranged to impart all of the required phase shift, or alternatively by a plurality of phase shifter components, each arranged to impart only a part of the total required phase shift. Typically, the one or more phase shifters are controllable to control an amount of phase shift to be imparted to the input signal to the antenna element. In this way, the phase shift imparted for a given antenna element can be changed as necessary to steer the transmitted beam in the most efficient direction (or directions) for the given application.

The one or more phase shifters may be one or more passive phase shifters. Thus, the one or more phase shifters are configured to alter the phase of the input signal without having an external power supply to the one or more phase shifters. The one or more phase shifters may be one or more MEMS phase shifters.

In another example, the signal modification component may comprise a true time delay component to delay propagation of the input signal to the antenna.

At least one sub-array may further comprise one or more RF switches. At least one sub-array circuit may further comprise an RF switch of the one or more RF switches. It will be understood that an RF switch is substantially any device to route alternating (e.g., high frequency) signals through one or more alternative transmission paths. For example, RF switches can be used to route signals through one of a plurality of transmission paths each for applying a different respective polarisation to the signal at the antenna. In another example, the RF switch is used to select a high-pass or low-pass network topology for a desired selectable phase shift. In some examples, an RF switch may be provided to alter the transmission path depending on whether the phased array antenna is to be operated in a transmit mode or in a receive mode.

The RF switch may be a passive component. Thus, the RF switch typically does not require an external power supply. As previously, it will be understood that a control signal cannot be considered to be an external power supply. The RF switch may be a MEMS RF switch.

Specifically, it will be understood that a PIN diode-based RF switch may be considered an example of a passive component because the PIN diode does not typically require an external power supply to perform the switching.

At least one electrical component in the plurality of sub-array circuits may be configured to selectively (e.g., controllably) alter the input signal.

At least one of the plurality of sub-array circuits may be controllable (i.e. controlled) independently of at least one other of the plurality of sub-array circuits. The at least one of the plurality of sub-array circuits may be of the same sub-array as the at least one other of the plurality of sub-array circuits. In other words, sub-array circuits of the same sub-array can be configured differently as required.

The phased array antenna apparatus may further comprise at least one controller configured to control the plurality of sub-array circuits. The method may comprise controlling the plurality of sub-array circuits.

Each sub-array may be provided with a separate respective controller for controlling each of the sub-array circuits of the sub-array. Thus, at least a portion of the control circuitry for controlling each of the sub-array circuits of a first sub-array may be separate from at least a portion of the control circuitry for controlling each of the sub-array circuits of a second sub-array.

It will be understood that the phased array antenna apparatus may comprise further control circuitry, provided away from the sub-array, for generally controlling each of the power amplifiers providing the amplified input signals to the respective sub-array circuits One or more power amplifiers may be provided with a power monitor for providing an indication of the power at the respective sub-array(s). Thus, the amplification output from power amplifiers can be monitored during calibration and/or during operation. In some examples, each of the power amplifiers is provided with a power monitor such that the amplification output of each of the power amplifiers can be monitored.

One or more of the power amplifiers may be configured to provide harmonic tuning. It will be understood that such functionality would typically not be economically feasible to provide were dedicated power amplifiers to be provided for each of the sub-array circuits in a sub-array. Harmonic tuning can provide optimized power amplifier efficiency and reduced spurious emissions.

One or more of the power amplifiers may be configured to be provided with DC/DC conversion. DC/DC conversion allows the power amplifier to be used at lower power levels with very little efficiency degradation.

One or more of the power amplifiers may be configured to operate in a Doherty or out-phased configuration. These configurations provide significant efficiency improvements as the power is reduced as compared to a standard power amplifier.

The plurality of sub-arrays may be at least 5. The plurality of sub-arrays may be at least 10.

The total number of antenna elements in the phased array antenna apparatus may be at least 100. The total number of antenna elements in the phased array antenna apparatus may be at least 1000.

The total number of sub-array circuits in the phased array antenna apparatus may be at least 100. The total number of sub-array circuits in the phased array antenna apparatus may be at least 1000.

A total number of power amplifiers may be fewer than a total number of sub-array circuits (e.g., antenna elements) in the phased array antenna apparatus.

Each sub-array may comprise at least nine antenna elements. Each sub-array may comprise at least 16 antenna elements. Each sub-array may comprise at least nine sub-array circuits. Each sub-array may comprise at least 16 sub-array circuits.

A total number of power amplifiers may be fewer than a total number of sub-arrays.

In accordance with another aspect of the present disclosure, there is provided a method of testing phased array antenna apparatus. The method comprises: providing the phased array antenna apparatus as described hereinbefore in embodiments having the plurality of test ports provided in a respective RF signal path between the plurality of power amplifiers and the plurality of antenna elements provided on a respective sub-array; and connecting test equipment to the plurality of test ports of the phased array antenna apparatus to test one or more signal characteristics of the RF signals output by the plurality of power amplifiers in the phased array antenna apparatus.

Thus, functionality of the phased array antenna apparatus, up to and including the functionality of the plurality of power amplifiers can be tested without requiring use of a time-consuming and expensive over-the-air (OTA) test procedure. Such a possibility is enabled by the provision of power amplifiers which provide the output signal to a plurality of sub-array circuits, and that are typically provided away from the sub-array circuits. Typically, the power amplifiers each have a standard output impedance, such as a 50 ohm output impedance. As described hereinbefore, in some examples, the testing can be carried out before the phased array antenna apparatus is fully assembled, that is, before the plurality of sub-arrays are mounted to the power amplifiers of the phased array antenna apparatus.

By having a test port having a standard output impedance, such as a 50 ohm output impedance, it will be understood that a functionality of the phased array antenna apparatus in either or both of transmit and receive configurations can be evaluated.

In accordance with a further aspect of the present disclosure, there is provided a method of assembling phased array antenna apparatus. The method comprises: providing a first portion of phased array antenna apparatus. The first portion comprises: a plurality of intermediate connection ports; a plurality of power amplifiers, each having an input and an output; and a phased array input port in RF signal communication with the input of each of the plurality of power amplifiers. The output of each respective power amplifier is in RF signal communication with a respective one of the plurality of intermediate connection ports. The method further comprises: connecting test equipment to one or more of the intermediate connection ports; performing a test procedure on the first portion using the test equipment; and providing a second portion of the phased array antenna apparatus. The second portion comprises a plurality of sub-arrays together configured to form a phased array antenna, each sub-array comprising a sub-array connection port, a plurality of (for example at least four) antenna elements, and a plurality of respective sub-array circuits between the sub-array connection port and an antenna of the respective antenna element. Each sub-array circuit is arranged to be provided with an amplified input signal via the respective sub-array connection port as an input signal to the sub-array circuit. The antenna is for transmission of the input signal. Each sub-array circuit comprises a signal delay component to delay propagation of the input signal to the antenna. The method further comprises connecting each intermediate connection port of the first portion to the respective sub-array connection port of the second portion to assemble the phased array antenna apparatus. When assembled, a phased array input signal applied at the phased array input port is provided to the plurality of antennas for onward transmission, via the intermediate connection ports, the sub-array connection ports and the sub-array circuits.

It will be understood that the test equipment may be connected to the one or more of the intermediate connection ports via a connection probe.

Thus, as described hereinbefore, the plurality of test ports (referred to above as intermediate connection ports) can be used firstly for connection of test equipment thereto and subsequently for further assembly of the phased array antenna apparatus by connection of the sub-array connection ports of the second portion thereto. In this way, testing ports need not continue to be provided in the phased array antenna apparatus once assembled.

Thus, in accordance with a yet further aspect of the present disclosure, there is provided phased array antenna apparatus for operation in frequencies above six gigahertz. The apparatus comprises a plurality of intermediate connection ports each for connection to a respective one of a plurality of sub-arrays. Each sub-array comprises a plurality of (e.g., at least four) antenna elements and a plurality of sub-array circuits between the input of the sub-array and a respective antenna of the at least four antenna elements. The apparatus comprises a plurality of power amplifiers, each having an input and an output, the output of each respective power amplifier in RF signal communication with a respective one of the plurality of intermediate connection ports. The apparatus comprises a phased array input port in RF signal communication with the input of each of the plurality of power amplifiers.

It will be understood that the present disclosure extends to performing the functions of any of the hereinbefore described features (in any combination), as well as to components configured to perform any one or more of the method functions hereinbefore described.

Although the disclosure above is directed to a phased array antenna apparatus for use as a receiver, it will be understood that a substantially similar phased array antenna apparatus can also be used in a receiver configuration.

DESCRIPTION OF THE DRAWINGS

An example embodiment of the present invention will now be illustrated with reference to the following Figures in which.

DETAILED DESCRIPTION OF AN EXAMPLE EMBODIMENT

As described hereinbefore, the present inventors have realised that phased array antenna apparatus can be formed having a plurality of sub-arrays, each having a plurality of antenna elements, an input configured to receive an input signal and a plurality of respective sub-array circuits between the input and the respective antenna element. The apparatus also comprises a plurality of power amplifiers. The sub-array circuits of each sub-array are connected to a one of the plurality of power amplifiers via the input. The power amplifier is configured to amplify a phased array input signal to provide an amplified input signal as the input signal at the input.

As a result, fewer power amplifiers are provided compared to phased array antennas of the prior art, which typically include a phased array antenna to amplify the input signal to each antenna element. By reducing the number of power amplifiers required, the cooling requirements of the phased array antenna are also reduced. Furthermore, by locating the power amplifier away from the antenna element, reduced cooling is required at the antenna element, resulting in a less complex and/or more resilient phased array antenna. Yet further, by using fewer power amplifiers, it is more economically and/or technically feasible to use power amplifiers having improved functionality, accuracy and/or reliability whilst still providing a relatively simple (and therefore cost-effective) phased array antenna for manufacture.

Figure 1:
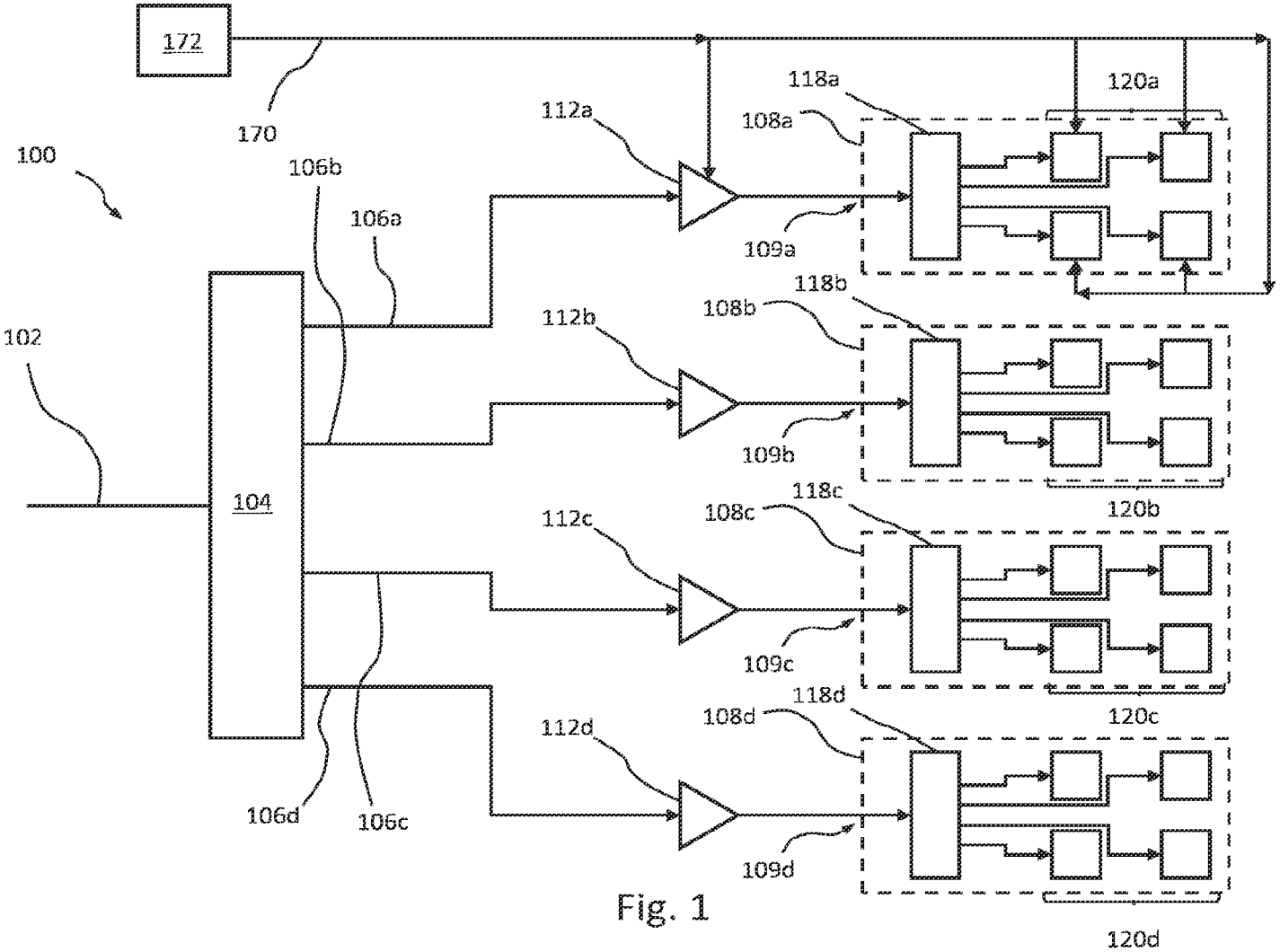
FIG. 1 shows a schematic representation of a portion of phased array antenna apparatus as disclosed herein.

FIG. 1 shows a schematic representation of a portion of phased array antenna apparatus as disclosed herein. The phased array antenna apparatus 100 is configured to receive a phased array input signal 102. The phased array input signal 102 is an input signal for transmission by the phased array antenna apparatus 100. Typically, the phased array input signal comprises a data signal, typically encoded on a carrier signal. Before transmission of the phased array input signal 102 from the phased array antenna apparatus 100, the data signal of the phased array input signal is encoded on a high-frequency carrier signal. The high-frequency carrier signal typically has a frequency from around six gigahertz or more, for example over ten gigahertz or even higher. In some examples, the data signal may be encoded on the high-frequency carrier signal to form the phased array input signal 102. In other examples, the data signal is encoded on the high-frequency carrier signal during subsequent signal processing within the phased array antenna apparatus. It will be understood that data signals can be encoded on carrier signals using substantially any of the techniques known to the skilled person, including amplitude modulation, frequency modulation, phase modulation or substantially any other modulation of the carrier frequency. FIG. 1 shows a simplified schematic representation of phased array antenna apparatus. Therefore, it will be understood that further elements, not shown in FIG. 1, may be provided in at least some implementations of the phased array antenna apparatus.

The phased array input signal 102 is typically already amplified, at least to an extent. The phased array input signal 102 is input to a splitter 104 to split the phased array input signal 102 into a plurality of (in this case, four) transmission paths 106*a*, 106*b*, 106*c*, 106*d*. Each transmission path 106*a*, 106*b*, 106*c*, 106*d* is directed towards a different sub-array 108*a*, 108*b*, 108*c*, 108*d* of the phased array antenna apparatus 100. Specifically, each transmission path 106*a*, 106*b*, 106*c*, 106*d* is directed towards an sub-array input 109*a*, 109*b*, 109*c*, 109*d* of the respective sub-array 108*a*, 108*b*, 108*c*, 108*d*.

As used herein, in some examples, the term "sub-array" will be understood to mean a separate physical module in the phased array antenna apparatus 100. In other examples, the term "sub-array" will be understood to mean a separate logical module in the phased array antenna apparatus, even if some components of a first sub-array 108*a* are co-located on the same board as one or more components of a second sub-array 108*b*.

A power amplifier is 112*a*, 112*b*, 112*c*, 112*d* is arranged in each of the transmission paths 106*a*, 106*b*, 106*c*, 106*d*, between the splitter 104 and the input 109*a*, 109*b*, 109*c*, 109*d*. Each power amplifier 112*a*, 112*b*, 112*c*, 112*d* is configured to receive the phased array input signal 102 for amplification, via the splitter 104, and to output the respective amplified input signal to the respective input 109*a*, 109*b*, 109*c*, 109*d* of the respective sub-array 108*a*, 108*b*, 108*c*, 108*d*. Amplification by the power amplifier 112*a*, 112*b*, 122*c*, 112*d* is necessary for the signal to have sufficient power to propagate a sufficient distance once transmitted from the phased array antenna apparatus 100.

An amplification level of each of the power amplifiers 112*a*, 112*b*, 112*c*, 112*d* is independently controllable. Typically, the power levels of the plurality of amplified input signals from the power amplifiers 112*a*, 112*b*, 112*c*, 112*d* are controlled such that at least one of the power levels is different to at least one other of the power levels. Typically, at least one of the power amplifiers 112*a*, 112*b*, 112*c*, 112*d* is different to at least one other of the power amplifiers 112*a*, 112*b*, 112*c*, 112*d*.

In the sub-array 108*a*, 108*b*, 108*c*, 108*d*, the amplified input signal received at the input 109*a*, 109*b*, 109*c*, 109*d* is directed through a plurality of sub-array circuits (not labelled in FIG. 1). The sub-array 108*a*, 108*b*, 108*c*, 108*d* comprises a further splitter 118*a*, 118*b*, 118*c*, 118*d*, arranged in each of the plurality of sub-array circuits of the sub-array 108*a*, 108*b*, 108*c*, 108*d* to split the amplified input signal received at the input 109*a*, 109*b*, 109*c*, 109*d* into four sub-array circuits for onward propagation to four antenna elements (shown grouped as 120*a*, 120*b*, 120*c*, 120*d* in FIG. 1).

It will be understood that each of the splitters described with reference to FIG. 1 can be implemented directly as a 1 to i splitter, where i is greater than 2. Whilst this particular embodiment has been described, it will be understood that substantially any splitter arrangement that splits the signal into the required number of signal paths can be used.

Control circuitry 170 is also shown. For simplicity, control circuitry 170 is only shown connected to first power amplifier 112*a* on the first transmission path 106*a* and to associated first group of antenna elements 120*a* in the first sub-array 108*a*. Nevertheless, it will be understood that control circuitry is typically provided for each of the other power amplifiers 112*b*, 112*c*, 112*d* and the other groups of antenna elements 120*b*, 120*c*, 120*d*. Control circuitry 170 carries one or more control signals from a controller 172 to control operation of the power amplifier 112*a*, and the antenna elements 120*a*.

The portion of the phased array antenna apparatus 100 connecting the power amplifiers 112*a*, 112*b*, 112*c*, 112*d* to the inputs 109*a*, 109*b*, 109*c*, 109*d* can each function as a test port for testing the operation of a portion of the phased array antenna apparatus including the power amplifiers 112*a*, 112*b*, 112*c*, 112*d* during assembly of the phased array antenna apparatus 100.

The components of the sub-arrays 108*a*, 108*b*, 108*c*, 108*d*, specifically the antenna elements 120*a*, 120*b*, 120*c*, 120*d*, will be described further with reference to FIGS. 2 and 3.

Figure 2:
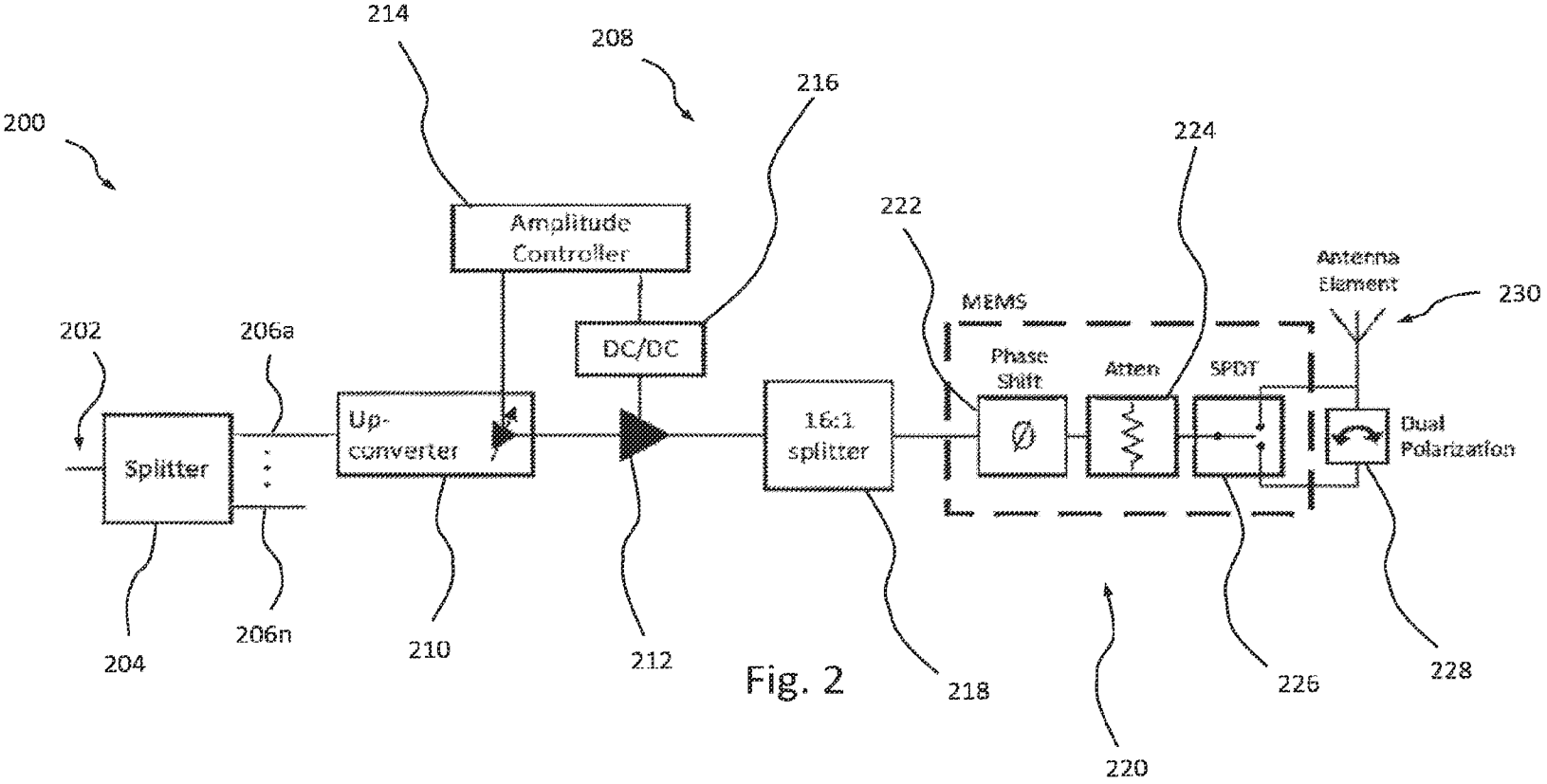
FIG. 2 shows a schematic representation of a portion of the phased array antenna apparatus shown in FIG. 1.

FIG. 2 shows a further example of a portion of phased array antenna apparatus. The phased array antenna apparatus 200 is substantially similar to the phased array antenna apparatus 100 described hereinbefore with reference to FIG. 1, apart from the hereinafter described distinctions. Like numerals are used to refer to like features, with the first digit of the numeral representative of the figure. Furthermore, FIG. 2 also provides further detail regarding the structure and functions of the antenna elements 120*a*, 120*b*, 120*c*, 120*d* described with reference to FIG. 1.

The splitter 204 is configured to split the phased array input signal 202 into N transmission paths 206*a* to 206*n*. FIG. 2 shows the signal processing operations performed in a first transmission path 206*a*, though it will be understood that similar signal processing operations can also be performed in the other signal paths.

After the phased array input signal 202 has been split by the splitter 204, the first transmission path 206*a* passes through an upconverter 210 to change the frequency of the phased array input signal 202 from a first frequency to a second frequency, higher than the first frequency, and to be transmitted from the phased array antenna apparatus 200.

The upconverted signal is next amplified by a power amplifier 212. An amplification level of the power amplifier 212 is set based on a signal from an amplitude controller 214. The amplification level of the upconverter 210 is also controlled by the amplitude controller 214. The amplitude controller 214 is controlled by a further control circuit (not shown). In this example, the signal from the amplitude controller 214 is further passed through a DC/DC voltage converter 216 before providing the control input to the power amplifier 212 to provide a particularly efficient implementation.

Following a further splitting of the signal in the further splitter 218, each of the signals passes to the antenna element 220. In FIG. 2, it will be understood that the input to the sub-array 208 is provided between the power amplifier 212 and the further splitter 218, such that the further splitter 218 is part of the sub-array 208. The antenna element 220 comprises a plurality of further components 222, 224, 226, 228 to further modify the signal input to the antenna element 220 from the further splitter 218.

Finally, the modified signal is transmitted from the phased array antenna apparatus 200 via an antenna 230.

A signal modification component 222 in the form of a phase shifter 222 alters a phase of the signal in the sub-array circuit from the further splitter 218 to the antenna 230. The phase shifter 222 is controllable to impart a phase shift different to one or more phase shifts imparted by other antenna elements having the signal propagated thereto from the further splitter 218. In this way, the phase of the signal can be modified to electronically steer the transmission beam of the phased array antenna apparatus 200.

An attenuator 224 provides attenuation of the signal in the transmission path from the further splitter 218 to the antenna 230. It will be understood that attenuating the signal allows a tapered amplitude profile of the transmitted signal from the plurality of antennas 230 of the sub-array 208 to be provided, even though the signals all originated from the same signal, amplified by the power amplifier 212.

An RF switch 226, in this example in the form of a single pole double throw (SPDT) switch 226 is provided to selectively route the signal through a polarisation-specific route 228 present for only one of the two transmission lines of the sub-array circuit between the SPDT switch 226 and the antenna 230. Thus, the polarisation of the signal transmitted by the antenna 230 can be controlled by operation of the SPDT switch 226. In other words, the RF switch 226 is used to select one of two feed ports for the antenna 230. Each feed port can be configured to excite a different polarisation in the antenna.

Each of the components of the sub-array 208 between the power amplifier 212 and the antenna element 230 are passive components. That is, each of the components of the sub-array 208 between the power amplifier 212 and the antenna element 230 are configured not to increase the power of the signal. Furthermore, each of the components of the sub-array 208 between the power amplifier 212 and the antenna element 230 are low-power components in that a power requirement for operation of the components is relatively low, in particular, less than the power requirement of the power amplifier 212. Furthermore, each of the components of the sub-array 208 between the power amplifier 212 and the antenna element 230 are low-loss components in that an inherent signal loss caused by the components during propagation from the further splitter 218 to the antenna 230 is low, for example less than 2.5 dB.

The phase shifter 222, the attenuator 224, and the RF switch 226 are each implemented as micro electro-mechanical systems (MEMS) components, in the form of MEMS switches, suitable implementations for which are known to the skilled person. Thus, the arrangement of the components 222, 224, 226, and therefore the antenna element itself 220 is compact.

Control of the phase shifter 222, the attenuator 224 and the RF switch 226 is provided by control signals received from control circuitry (not shown). It will be understood that the control circuitry can be provided at the sub-array 208, for example at the antenna elements 220, or away from the antenna elements 220. In some examples, the control circuitry may be distributed between several portions of the phased array antenna apparatus 200.

The power amplifier 212 may comprise additional functionality in some examples. For example, the power amplifier 212 can provide harmonic tuning to improve efficiency of the phased array antenna apparatus 200.

Typically, the power amplifiers 212 in each of a plurality of sub-arrays 208 of the phased array antenna apparatus 200 are each different, such that in a first sub-array of the phased array antenna apparatus 200, a first amplified input signal is provided to the antenna elements from a first power amplifier, and in a second sub-array of the phased array antenna apparatus 200, a second amplified input signal is provided to the antenna elements from a second power amplifier. The first amplified input signal is amplified more than the second amplified input signal. The first sub-array may be mounted closer to a centre of the phased array antenna apparatus than the second sub-array. In this way, it can be seen that amplitude tapering can be provided for sub-arrays of the phased array antenna apparatus. By choosing each amplifier to be capable of efficiently providing the required amplification to achieve the desired amplitude tapering, a particularly efficient implementation of the phased array antenna apparatus can be provided.

In some embodiments, a test port can be provided in the transmission path from the power amplifier 212 towards the antennas 230 (not shown in FIG. 1). In this way, it will be understood that it will be possible to test performance of the phased array antenna apparatus 200, including the power amplifier 212, without use of an over-the-air (OTA) antenna test, which can often be time-consuming and expensive to undertake. The phased array antenna apparatus 200 can be tested during manufacture, even before connection of the antenna elements 220 of the sub-arrays 208 thereto. Of course, it will also be understood that the testing may be of only certain components in the phased array antenna apparatus 200, typically including the power amplifier 212.

Although the above disclosure has described phased array antenna apparatus 100, 200 for use as a transmitter, it will be understood that the phased array antenna apparatus 100, 200 described herein can further be used instead or additionally as a receiver. In examples where the phased array antenna apparatus is to be used as a receiver, it will be understood that a low noise amplifier (LNA) will typically be provided instead of, or in a further transmission path in parallel with the power amplifier. The low noise amplifier is configured to amplify the signals received by the antennas of the phased array apparatus 100, 200.

Figure 3:
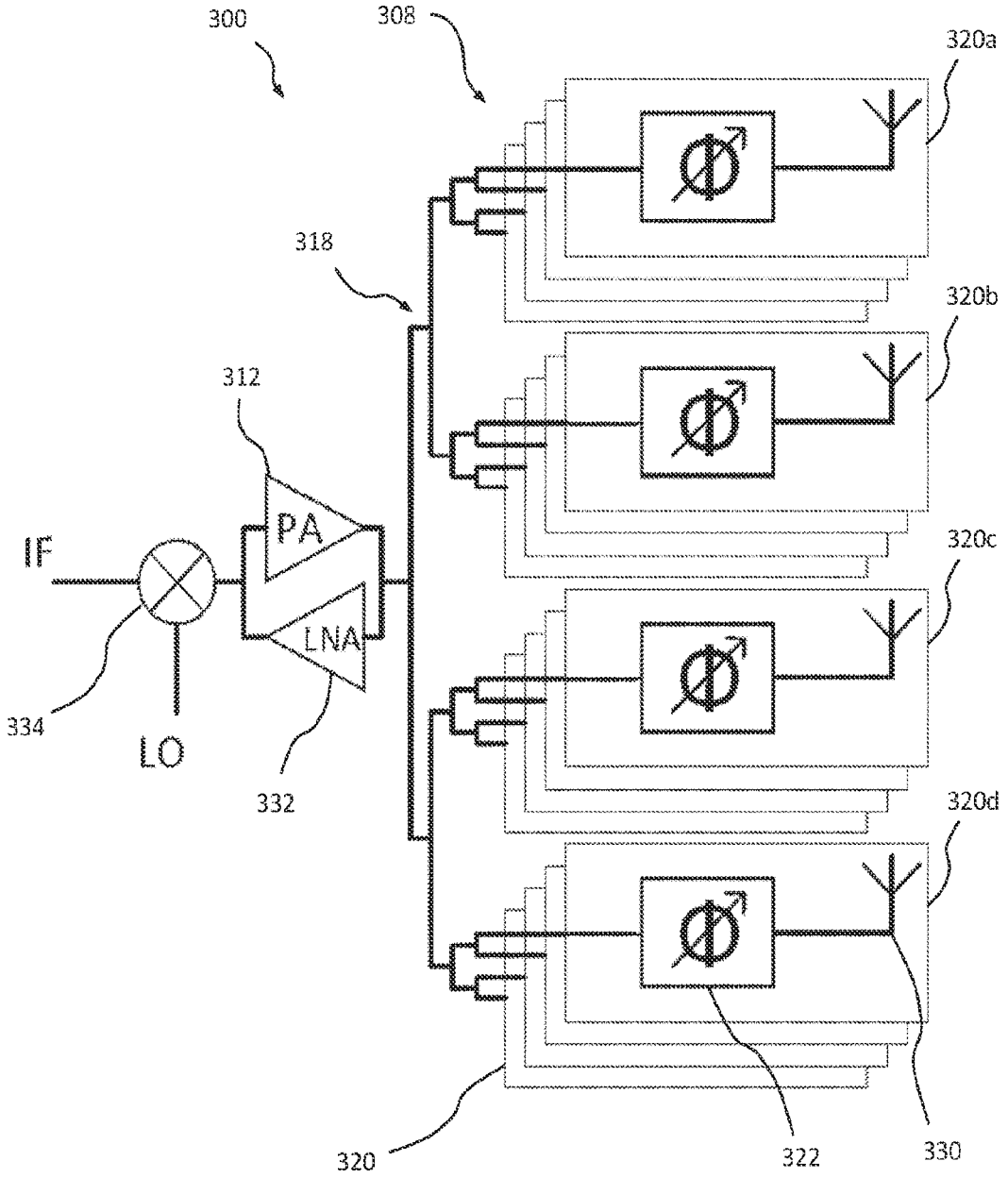
FIG. 3 shows a further schematic illustration of a phased array antenna apparatus as disclosed herein.

FIG. 3 shows a further schematic illustration of a phased array antenna apparatus as disclosed herein. The phased array antenna apparatus 300 comprises a plurality of antenna elements 320*a*, 320*b*, 320*c*, 320*d* forming a sub-array 308. The plurality of antenna elements are each configured to receive an amplified input signal from a power amplifier 312 via a splitter network 318. In a receive configuration, a low noise amplifier 332 is arranged to receive a received signal from each of the plurality of antenna elements 320*a*, 320*b*, 320*c*, 320*d*. As in FIGS. 1 and 2, each transmission path, sometimes referred to as each sub-array circuit, between each respective antenna 330 and the power amplifier 312 (or the low noise amplifier 332) comprises a respective signal modification component 322 in the form of a phase shifter 322. Although not shown in FIG. 3, it will also be understood that additional components such as an RF switch and an attenuator can also be included in some or all of the transmission paths between each respective antenna 330 and the power amplifier 312 (or the low noise amplifier 332) as required.

Depending on the operational mode of the phased array antenna apparatus 300, mixer 334 may function as an upconverter or a downconverter. When the phased array antenna apparatus 300 is operating in the transmit operational mode, the mixer 334 functions as an upconverter. When the phased array antenna apparatus 300 is operating in the receive operational mode, the mixer 334 functions as a downconverter. The operation of an upconverter and a downconverter will be understood by the person skilled in the art.

For clarity, not every single element has been labelled in FIG. 3. Nevertheless, it will be understood that FIG. 3 illustrates a phased array antenna system 300 in which the sub-array 308 comprises 16 antenna elements 320*a*, 320*b*, 320*c*, 320*d*, each having a phase shifter 322 and an antenna 330.

Figure 4:
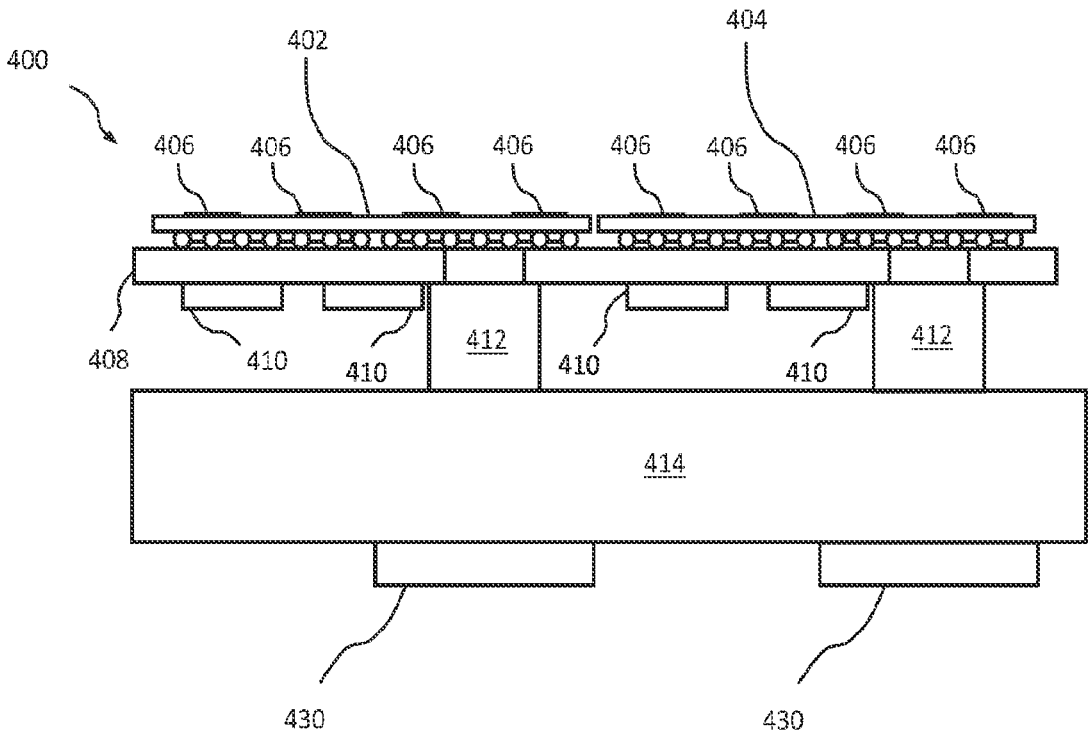
FIG. 4 shows a schematic representation of an example of a phased array antenna apparatus as disclosed herein.

FIG. 4 shows a schematic representation of a phased array antenna apparatus as disclosed herein. The phased array antenna apparatus 400 comprises a first sub-array board 402 and a second sub-array board 404. Although only two sub-array boards 402, 404 are shown, it will be understood that more may be present, for example at least four, at least 16, or even more. The sub-array boards 402, 404 are each provided with MEMS components of the antenna elements 406 fabricated thereon, and also further comprise the antennas provided thereon (not shown). A motherboard 408 is mounted at an underside of the sub-array boards 402, 404. The motherboard comprises a plurality of amplifiers, including a plurality of power amplifiers 410, each for supplying an amplified input signal to the plurality of antenna elements 406 forming a respective sub-array on the sub-array boards 402, 404, as described hereinbefore.

Heat transfer away from the motherboard 408 is facilitated via heat-conductive standoffs 412, in this example formed from brass, to conduct heat away from the motherboard 308 to a back plane 414. The back plane 414 is formed from aluminium.

Figure 5:
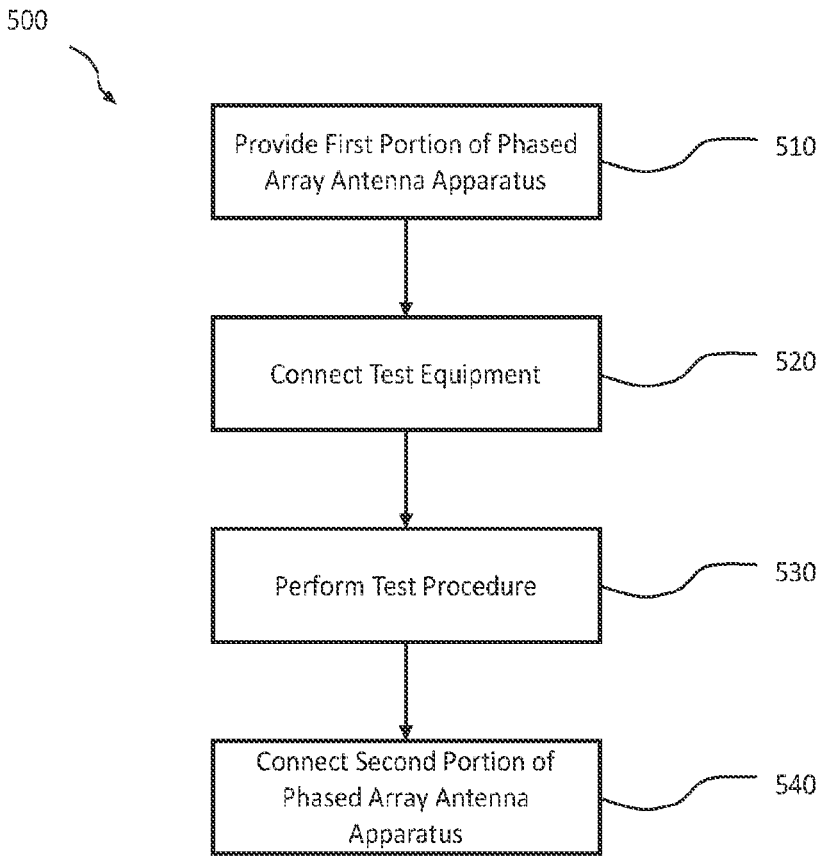
FIG. 5 shows a flowchart illustrating a method of relevance to a phased array antenna apparatus as disclosed herein.

FIG. 5 shows a flowchart illustrating a method of testing a phased array antenna during assembly. In brief, the method 500 comprises testing the power amplifiers of the phased array antenna apparatus 100, 200, 300, 400 during assembly, without requiring an over the air (OTA) test.

The method 500 comprises providing 510 a first portion of phased array antenna apparatus, substantially as described hereinbefore. The first portion of the phased array antenna apparatus comprises a phased array input port, a plurality of power amplifiers and a plurality of intermediate connection ports. The phased array input port is for receiving a phased array input signal, including for example a test input signal. The phased array input port is in signal communication with an input of each of the plurality of power amplifiers. The plurality of power amplifiers each have the input and an output. The output of each power amplifiers is in signal communication with a respective one of the plurality of intermediate connection ports. Thus, the amplified signals, output from the power amplifiers, are each provided to the respective intermediate connection ports.

The method 500 further comprises connecting 520 test equipment to one or more of the intermediate connection ports. The test equipment can be substantially any suitable equipment for detecting and measuring an output at each of the plurality of intermediate connection ports to a test input signal provided as a phased array input signal.

The method 500 further comprises performing 530 a test procedure on the first portion of the phased array antenna apparatus using the test equipment. Thus, the functionality of any of the components of the phased array antenna apparatus between the phased array input port and the output of the power amplifier can be evaluated in the test procedure.

The method further comprises connecting 540 each intermediate connection port of the first portion of the phased array antenna apparatus to a second portion of the phased array antenna apparatus. The second portion of the phased array antenna apparatus comprises a plurality of sub-arrays together configured to form a phased array antenna. Each sub-array comprises a sub-array connection port, a plurality (e.g., at least four) antenna elements and a plurality of respective sub-array circuits between the sub-array connection port and an antenna of the respective antenna element. Each sub-array circuit is arranged to be provided with an amplified input signal via the respective sub-array connection port as an input signal to the sub-array circuit. The antenna is configured to transmit the input signal. Each sub-array circuit comprises a signal delay component. The signal delay component is configured to adjust the phase of the input signal to the antenna. In this way, when assembled, the phased array input signal applied at the phased array input port is provided to the plurality of antennas for onward transmission, via the intermediate connection ports, the sub-array connection ports and the sub-array circuits.

The steps of the method 500 are typically performed in the order described. In other words, performing 530 the test procedure usually occurs prior to connecting 540 each intermediate connection port to the second portion of the phased array antenna apparatus.

Figure 6:
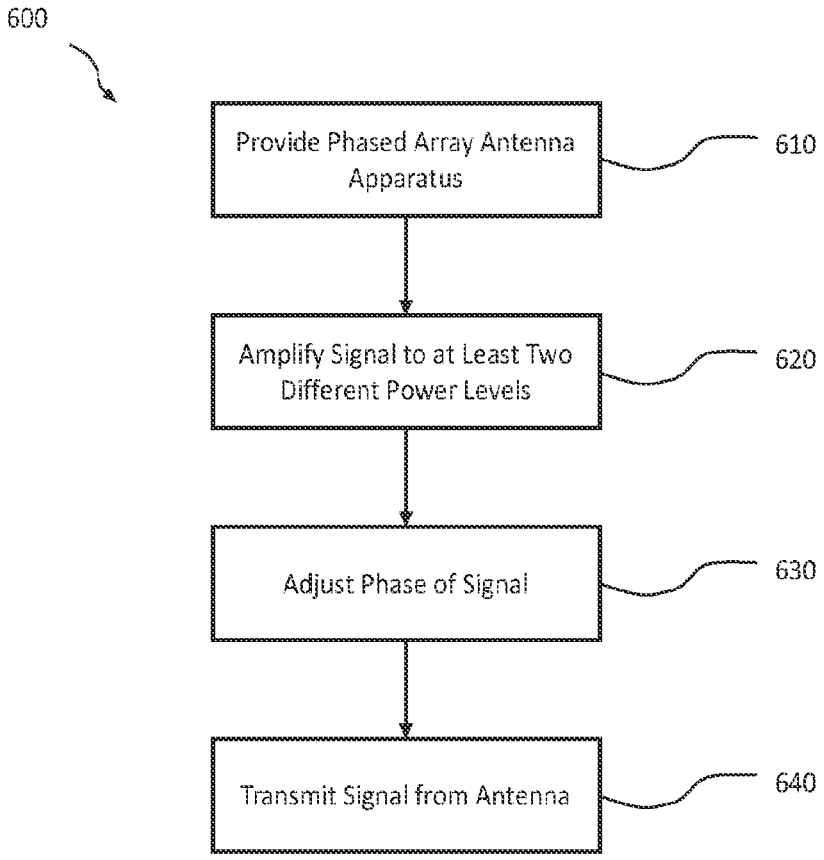
FIG. 6 shows a further flowchart illustrating a method of relevance to a phased array antenna apparatus as disclosed herein.

FIG. 6 shows a flowchart illustrating a method of operating a phased array antenna. In brief, the method 600 comprises amplifying a phased array input signal to at least two respective, different power levels and providing a one of the amplified signals as the input to the sub-arrays of the phased array antenna apparatus. In this way, the amplification is performed before the signal is split up to be sent to individual antenna elements in the sub-arrays.

The method 600 comprises providing 610 phased array antenna apparatus, for example as described hereinbefore. The phased array antenna apparatus comprises a phased array input and a plurality of sub-arrays. The phased array input is configured to receive a phased array input signal. The plurality of sub-arrays are together configured to form a phased array antenna. Each sub-array comprises a plurality of (e.g., at least four) antenna elements, an input and a plurality of respective sub-array circuits between the input and an antenna of the respective antenna element. The input is configured to receive an input signal. The antenna is for transmission of the input signal.

The method 600 further comprises amplifying 620 the phased array input signal to at least two different respective power levels for providing as the input to each of the plurality of sub-arrays.

The method 600 further comprises adjusting 630 a phase of the input signal to the antenna in one or more sub-array circuits. In some examples, the method 600 may further comprise performing other operations in relation to the input signal before the input signal is received at the antenna, for example attenuation and or switched routing.

The method 600 further comprises transmitting the input signal from the antenna.

Although the present disclosure has been described with reference to carrier frequencies over six gigahertz, it will be understood that in other examples, the carrier frequency may be substantially any carrier frequency for which phased array antennas may be used, even frequencies below six gigahertz.

In summary, there is provided phased array antenna apparatus (200) for operation in frequencies above six gigahertz. The apparatus (200) comprises: a plurality of sub-arrays (208) together configured to form a phased array antenna, each sub-array (208) comprising at least four antenna elements (220), each antenna element (220) for receiving an input signal from the sub-array (220) and comprising: an antenna (230) for transmission of the input signal; and a phase shift component (222) to adjust the phase of the input signal to the antenna (230); and a plurality of power amplifiers (212), wherein each sub-array (208) is provided with a one of the plurality of power amplifiers (212), wherein each sub-array (208) is arranged to be provided with an amplified input signal, and each antenna element (220) of the sub-array (208) is configured to be provided with the amplified input signal of the respective sub-array (208) as the input signal to the antenna element (220), and wherein the power amplifier (212) for each sub-array (208) is configured to receive a phased array input signal for amplification and to output the respective amplified input signal to the respective sub-array (208).

Features and characteristics described herein in relation to particular embodiments and examples will be understood to be applicable to any other embodiments and examples described herein, or otherwise falling within the scope of the disclosure, in any suitable combination, unless explicitly excluded. The scope of the disclosure is not intended to be limited to the particular examples and embodiments described herein.

The invention claimed is:

1. A phased array antenna apparatus for operation in frequencies above six gigahertz, the phased array antenna apparatus comprising:

a plurality of sub-arrays together configured to form a phased array antenna, each sub-array comprising at least four antenna elements, an input configured to receive an input signal, and a plurality of respective sub-array circuits between the input and an antenna of the respective antenna element, the antenna for transmission of the input signal, each sub-array circuit comprising:

a signal modification component configured to adjust a phase of the input signal during propagation to the antenna; and an attenuator to attenuate the input signal during propagation to the antenna, such that fine tuning of an amplitude tapering of the sub-array is provided; and a plurality of power amplifiers, wherein the sub-array circuits of each sub-array are connected to a one of the plurality of power amplifiers via the input, wherein each sub-array is arranged to be provided with an amplified input signal at the input as the input signal to the input, wherein each power amplifier is configured to receive a phased array input signal for amplification and to output the respective amplified input signal to the plurality of sub-array circuits of the respective sub-array connected to the power amplifier, wherein a first power amplifier of the plurality of power amplifiers, providing the amplified input signal to the input of a central sub-array of the plurality of sub-arrays in the phased array antenna apparatus is configured to amplify the phased array input signal to a greater power than a second power amplifier of the plurality of power amplifiers, providing the amplified input signal to the input of a peripheral sub-array of the plurality of sub-arrays in the phased array antenna apparatus, such that a majority of the amplitude tapering is provided by the power amplifiers providing different amplitudes for the sub-arrays.

2. The phased array antenna apparatus of claim 1, wherein the attenuator of each sub-array circuit is configured to provide fine tuning of the amplification of the amplified input signal to the sub-array circuit to the respective sub-array.

3. The phased array antenna apparatus of claim 1, wherein each power amplifier is provided on a control board of the phased array antenna apparatus, separate from one or more antenna boards of the sub-array, at which the plurality of antenna elements are provided, and wherein the control board is provided away from the sub-array.

4. The phased array antenna apparatus of claim 1, comprising a plurality of test ports for connection of test equipment thereto, each test port provided in the plurality of sub-array circuits of a respective sub-array.

5. The phased array antenna apparatus of claim 1, further comprising at least one controller configured to control the plurality of sub-array circuits, and wherein each sub-array is provided with a separate respective controller for controlling each of the sub-array circuits of the sub-array.

6. The phased array antenna apparatus of claim 1, wherein the attenuator comprises a passive attenuator.

7. The phased array antenna apparatus of claim 6, wherein the attenuator comprises a micro electro-mechanical systems (MEMS) attenuator.

8. The phased array antenna apparatus of claim 6, wherein, of passive attenuation and power amplification of the amplified input signal, only passive attenuation of the amplified input signal is performed in the sub-array circuit.

9. The phased array antenna apparatus of claim 1, wherein in at least one of the plurality of sub-array circuits, of one or more active components and one or more passive components to modify the amplified input signal received at the input, only the one or more passive components are provided, and wherein each of the one or more passive components is configured to receive a control signal having a maximum current of less than 100 milliamps.

10. The phased array antenna apparatus of claim 9, wherein the one or more passive components comprises one or more micro electro-mechanical systems (MEMS) components, and wherein the one or more MEMS components are configured to provide at least two of attenuation, phase shift, and RF switching to the amplified input signal in the sub-array circuit.

11. The phased array antenna apparatus of claim 1, wherein each signal modification component comprises one or more phase shifters configured to impart a phase shift to the input signal to thereby adjust the phase of the input signal during propagation to the antenna, and wherein the one or more phase shifters are one or more passive phase shifters.

12. The phased array antenna apparatus of claim 1, wherein at least one sub-array further comprises one or more radio frequency (RF) switches, and wherein the one or more RF switches are each passive components.

13. The phased array antenna apparatus of claim 1, wherein at least one electrical component in the plurality of sub-array circuits is configured to selectively alter the input signal.

14. The phased array antenna apparatus of claim 1, wherein at least one of the plurality of sub-array circuits is controllable independently of at least one other of the plurality of sub-array circuits.

15. The phased array antenna apparatus of claim 1, wherein one or more of the power amplifiers are provided with a power monitor for providing an indication of the power at the respective sub-array or sub-arrays.

16. The phased array antenna apparatus of claim 1, wherein one or more of the power amplifiers are configured to provide harmonic tuning.

17. The phased array antenna apparatus of claim 1, wherein one or more of the power amplifiers are configured to be provided with DC/DC conversion.

18. The phased array antenna apparatus of claim 1, wherein the phased array antenna apparatus further comprises a plurality of test ports for connection of test equipment thereto, each test port provided in the plurality of sub-array circuits of a respective sub-array, wherein one or more of the power amplifiers are configured to be provided with DC/DC conversion, and wherein one or more power amplifiers are provided with a power monitor for providing an indication of the power at the respective sub-array or sub-arrays.

19. A method of operating a phased array antenna apparatus at frequencies above 6 GHz, the method comprising:

providing a phased array antenna apparatus comprising:

a phased array input configured to receive a phased array input signal; and a plurality of sub-arrays together configured to form a phased array antenna, each sub-array comprising at least four antenna elements, an input configured to receive an input signal, and a plurality of respective sub-array circuits between the input and an antenna of the respective antenna element, the antenna for transmission of the input signal;

amplifying the phased array input signal provided to the input of a central sub-array of the plurality of sub-arrays in the phased array antenna apparatus, to a greater power than the phased array input signal provided to the input of a peripheral sub-array of the plurality of sub-arrays, such that a majority of amplitude tapering is provided by the power amplifiers providing different amplitudes for the sub-arrays;

adjusting a phase of the input signal during propagation to the antenna in one or more of the sub-array circuits;

attenuating the input signal during propagation to the antenna in each of the sub-array circuits, such that fine tuning of the amplitude tapering of the sub-array is provided; and transmitting the input signal from the antenna.

20. The method of claim 19, further comprising switchedly routing the input signal in one or more of the sub-array circuits.

* * * * *